US008062578B2

(12) United States Patent
Noda et al.

(10) Patent No.: US 8,062,578 B2
(45) Date of Patent: Nov. 22, 2011

(54) TILTING-TYPE AUTOMATIC POURING METHOD AND A MEDIUM THAT STORES PROGRAMS TO CONTROL THE TILTING OF A LADLE

(75) Inventors: Yoshiyuki Noda, Toyohashi (JP); Kazuhiko Terashima, Toyohashi (JP); Takanori Miyoshi, Toyohashi (JP); Kazuhiro Ota, Shinshiro (JP); Makio Suzuki, Shinshiro (JP)

(73) Assignees: Sintokogio, Ltd., Aichi (JP); National University Corporation Toyohashi University of Technology, Aichi (JP)

( * ) Notice: Subject to any disclaimer, the term of this patent is extended or adjusted under 35 U.S.C. 154(b) by 0 days.

(21) Appl. No.: 12/597,876

(22) PCT Filed: Apr. 21, 2008

(86) PCT No.: PCT/JP2008/057688

§ 371 (c)(1),
(2), (4) Date: Oct. 27, 2009

(87) PCT Pub. No.: WO2008/136295

PCT Pub. Date: Nov. 13, 2008

(65) Prior Publication Data

US 2010/0059555 A1 Mar. 11, 2010

(30) Foreign Application Priority Data

Apr. 28, 2007 (JP) ..... 2007-120366

(51) Int. Cl.
*B22D 41/06* (2006.01)

(52) U.S. Cl. ..... 266/45; 266/99; 222/590; 222/604

(58) Field of Classification Search ..... 266/45, 266/236, 99; 222/590, 604
See application file for complete search history.

(56) References Cited

U.S. PATENT DOCUMENTS 6,280,499 B1 * 8/2001 Koffron ..... 75/375
(Continued)

FOREIGN PATENT DOCUMENTS

JP 62-11290 1/1987
(Continued)

OTHER PUBLICATIONS

Kazuhiro Shinohara et al., "Development of Automatic Pouring Equipment," Automobile Technology, 1992, vol. 46, No. 11, pp. 79-86.

(Continued)

*Primary Examiner* — Scott Kastler
(74) *Attorney, Agent, or Firm* — Finnegan, Henderson, Farabow, Garrett & Dunner, L.L.P.

(57) ABSTRACT

A method for controlling a ladle to pour molten metal into a sprue of a mold. The method includes obtaining a mathematical model describing a locus of positions where the molten metal flowing from the ladle drops on an upper surface of the sprue. The method further includes solving an inverse problem of the mathematical model, estimating a position where the molten metal drops using a result of the solving of the inverse problem, and determining target voltages to be supplied to servomotors controlling the ladle. At least the target voltage to be supplied to one of the servomotors is determined based on the estimated position. The method also includes controlling the servomotors based on respective target voltages.

2 Claims, 8 Drawing Sheets

U.S. PATENT DOCUMENTS

| | | | | |
|---|---|---|---|---|
| 2010/0010661 | A1* | 1/2010 | Terashima et al. | 700/146 |
| 2010/0059555 | A1* | 3/2010 | Noda et al. | 222/604 |
| 2010/0116855 | A1* | 5/2010 | Noda et al. | 222/590 |
| 2010/0133302 | A1* | 6/2010 | Noda et al. | 222/590 |

FOREIGN PATENT DOCUMENTS

| | | |
|---|---|---|
| JP | 9-10924 | 1/1997 |
| JP | 9-285860 | 4/1997 |
| JP | 9-239525 | 9/1997 |
| JP | 10-58120 | 3/1998 |
| JP | 2005-088041 | 4/2005 |

OTHER PUBLICATIONS

Masao Matsuda et al., "Approach for an Increase in Flow Rate at Start of Pouring from Auto Pouring Equipment by 2-Stage Up-Down Mechanism of Tilt-Center," Journal of Japan Foundry Engineering Society, 1999, vol. 71, No. 7, pp. 443-448.

Ken'Ichi Yano et al., "Pouring Flow Rate Control of Cylindrical Ladle-Type Automatic Pouring Robot by Applying Betterment Process," Transactions of the Japan Society of Mechanical Engineers, 2004, vol. 70, No. 694; pp. 206-213.

* cited by examiner

TILTING-TYPE AUTOMATIC POURING METHOD AND A MEDIUM THAT STORES PROGRAMS TO CONTROL THE TILTING OF A LADLE

TECHNICAL FIELD

This invention relates in general to casting technology. In particular it relates to a tilting-type automatic pouring method wherein an amount of molten metal, such as a ferrous molten metal or aluminum molten metal, is held in a ladle, and the molten metal is poured into a mold by tilting the ladle.

BACKGROUND TECHNOLOGY

Various conventional tilting-type automatic pouring methods are known, such as shown below:

1) the method that controls the vibrations of molten metal when it is transported to the pouring position (Patent Document 1)
2) the method that controls the vibrations of molten metal caused by the backward tilting of the ladle at the completion of pouring (Patent Document 2)
3) the method that controls the speed of the tilting of the ladle so as to maintain the constant flow of metal (Patent Document 3)
4) the method that completes the pouring of the predetermined weight of the molten metal in a short time (Patent Document 4)
5) the method that controls the speed of the tilting so as to achieve the desired pouring pattern
6) the method that increases the flow of molten metal that flows from the ladle at the early stage of pouring by elevating or lowering the outflow position of the ladle (Non-patent Document 1)
7) the tilting-type automatic pouring method that uses fuzzy controls (Non-patent Document 2)
8) the tilting-type automatic pouring method that uses a linear parameter deformation model (Non-patent Document 3)

For 1) and 2), the method is concerned with controlling the vibrations of the surface of the molten metal during the transport of the ladle or when the ladle is tilted. Neither of the methods refers to realizing the desired flow rate in the pouring. In 3) and 5) the method controls the weight of the molten metal that is poured per unit of time. In 4), 6), and 7) the method aims to precisely pour the predetermined weight of the molten metal. In 6) the method aims to minimize the time of pouring by lowering an outflow position of the ladle and thereby increase the flow of the molten metal that flows from the ladle. These methods are all concerned with precise control of the flow rate or the weight of the molten metal that is poured. None of them controls the position where the molten metal drops when the tilting-type automatic pouring method is used. Thus there still remains a problem in that the position of the molten metal poured from the ladle often drops outside a sprue, and that problem should be addressed.

Patent Document 1: Publication of a Japanese Patent Application, Publication No. H09-10924

Patent Document 2: Publication of a Japanese Patent Application, Publication No. H09-285860

Patent Document 3: Publication of a Japanese Patent Application, Publication No. H9-239525

Patent Document 4: Publication of a Japanese Patent Application, Publication No. H10-58120

Non-Patent Document 1: "A Proposal to Maximize an Initial Flow of the Molten Metal in a Lifting and Lowering Device with a Two-stage Tilting Axis of a Tilting-type Automatic Pouring Machine"; *Creative Engineering*, Vol. 71, No. 7, pp 445-448, 1999

Non-Patent Document 2: "Development of an Automatic Pouring Machine"; *Automobile Technology*, Vol. 46, No. 11, pp 79-86, 1992

Non-Patent Document 3: "Control of the Flow of Pouring by Betterment Process in Cylindrical Ladle-type Automatic Pouring Robot"; *Japan Society of Mechanical Engineers, Papers C*, Vol. 70, No. 69, pp 4,206-4,213, 2004

DISCLOSURE OF THE INVENTION

Problems to be Solved by the Invention

To solve these problems, the present invention provides a method of pouring molten metal, which method enables the molten metal that flows from a ladle to precisely drop in the sprue of a mold. The present invention also provides a medium that stores programs for controlling the tilting of the ladle.

Means to Solve Problems

To achieve the above objective, the tilting-type automatic pouring method of the present invention is one for a tilting-type automatic pouring apparatus provided with a servomotor that controls the tilting of a ladle that holds molten metal, one that controls the backward and forward movement of the ladle, and one that controls the lifting and lowering of the ladle, whereby the molten metal is poured into a mold by the tilting of the ladle, wherein the method enables the molten metal that flows from the ladle to drop precisely into a sprue of a mold by controlling by a computer the input voltages that are to be supplied to the respective servomotors, which tilt the ladle, move the ladle backward and forward, and move the ladle up and down, wherein the method comprises:

obtaining a mathematical model covering the locus of the positions where the molten metal that flows from the ladle drops;

solving the inverse problem of the mathematical model thus obtained;

estimating the position where the molten metal drops from the term for the estimated flow of the molten metal and from the term for the estimated position where the molten metal drops; and processing by the computer the data on the estimated positions where the molten metal drops, whereby the pouring of the molten metal is effected by determining the electrical voltages to be supplied to the respective servomotors, which tilt the ladle, move the ladle backward and forward, and move the ladle up and down, and controlling the three motors based on the electrical voltages thus determined, and move the ladle so that the position where the molten metal drops can be within the sprue of the mold.

The method of the mathematical model that is used for the purpose of the present invention is one that comprises 1) obtaining a function, by solving the expressions relating to the thermal balance of a process, the balance of substances, chemical reactions, restricting conditions, etc., the function being related to the profits, costs, etc., that are the objects to be controlled by a computer, 2) obtaining their maximum and minimum values from the function and 3) then controlling the process to achieve them.

In the present invention, a cylindrical ladle that has a rectangular-shaped outflow position, or a ladle having the shape of a fan in its longitudinal cross section, which ladle has a rectangular-shaped outflow position, is used. The ladle is supported at a position near to its center of gravity.

Effects of the Invention

The present invention provides a method to precisely drop the molten metal that flows from the ladle into the sprue of the mold by moving the ladle backward and forward and controlling the position where the molten metal drops. In this way the molten metal does not miss the position of the drop in the pouring process and it drops precisely in the sprue, whereby the pouring can be done safely and without any loss of the molten metal.

BEST MODE OF CARRYING OUT THE INVENTION

Below the best mode of carrying out the invention is explained. FIG. 1 shows a schematic illustration of the tilting-type automatic pouring apparatus 1 to which the present invention is applied. The tilting-type automatic pouring apparatus 1 has a ladle 2, which can be tilted, moved backward and forward, and moved up and down by the servomotors 3, 3 that are disposed at some locations of the tilting-type automatic pouring apparatus 1. The servomotors 3, 3 each have a rotary encoder, which can measure the position of the ladle and the angle of tilting of the ladle 2. Further, the servomotors 3, 3 receive from a computer the instructions for controlling the ladle.

The computer is a "motion-controller," which includes a personal computer, microcomputer, programmable logic controller or digital signal processor (DSP).

In FIG. 2, which shows a vertical cross-sectional view of the ladle 2 when it is pouring, given that θ (degree) is the angle of the tilting of the ladle 2, Vs (θ) ($m^3$) is the volume of the molten metal (a darkly shaded region) below the line which runs horizontally through the outflow position, which is the center of tilting of the ladle 2, A (θ) ($m^2$) is the horizontal area on the outflow position (the area bordering the horizontal area between the darkly shaded region and the lightly shaded region), Vr ($m^3$) is the volume of the molten metal above the outflow position (the lightly shaded region), h (m) is the height of the molten metal above the outflow position, and q ($m^3$/s) is the volume of the molten metal that flows from the ladle 2, then the expression that shows the balance of the molten metal in the ladle 2 from the time t (s) to the Δt after t (s) is given by the following expression (1):

$$V_r(t)+V_s(\theta(t))=V_r(t+\Delta t)+V_s(\theta(t+\Delta t))+q(t)\Delta t \tag{1}$$

If the terms that have Vr ($m^3$) in expression (1) are brought together and Δt is cause to be →0, the following expression (2) is obtained:

$$\begin{aligned}\lim_{\Delta t\to 0}\frac{V_r(t+\Delta t)-V_r(t)}{\Delta t} &= \frac{dV_r(t)}{dt} \\ &= -q(t)-\frac{dV_s(\theta(t))}{dt} \\ &= -q(t)-\frac{\partial V_s(\theta(t))}{\partial\theta(t)}\frac{d\theta(t)}{dt}\end{aligned} \tag{2}$$

Also, the angular velocity of the tilting of the ladle 2, ω (degree/s), is defined by the following expression (3):

$$\omega=d\theta(t)/dt \tag{3}$$

If expression (3) is substituted for the value in expression (2), then expression (4) is obtained.

$$\frac{dV_r(t)}{dt}=-q(t)-\frac{\partial V_s(\theta(t))}{\partial\theta(t)}\omega(t) \tag{4}$$

The volume of the molten metal above the outflow position, Vr ($m^3$), is given by the following expression (5):

$$V_r(t)=\int_0^{h(t)}A_s(\theta(t),h_s)dh_s \tag{5}$$

Area $A_s$ ($m^2$) shows the horizontal area of the molten metal at height $h_s$ (m) above the horizontal area on the outflow position, as shown in FIG. 3.

If area $A_s$ ($m^2$) is broken down into the horizontal area of the outflow position A ($m^2$) and the amount of the change of area $\Delta A_s$ ($m^2$) over the area A ($m^2$), then the volume Vr ($m^3$) is given by the following expression (6):

$$\begin{aligned}V_r(t) &= \int_0^{h(t)}(A(\theta(t))+\Delta A_s(\theta(t),h_s))\,dh_s \\ &= A(\theta(t))h(t)+\int_0^{h(t)}\Delta A_s(\theta(t),h_s)\,dh_s\end{aligned} \tag{6}$$

With ladles in general, including the ladle 2, because the amount of the change of area $\Delta A_s$ ($m^2$) is very small compared with the horizontal area on the outflow position A ($m^2$), the following expression (7) is obtained:

$$A(\theta(t))h(t)<<\int_0^{h(t)}\Delta A_s(\theta(t),h_s)dh_s \tag{7}$$

Thus expression (6) can be shown as the following expression (8):

$$V_r(t)\approx A(\theta(t))h(t) \tag{8}$$

Then the following expression (9) is obtained from expression (8):

$$h(t)\approx V_r(t)/A(\theta(t)) \tag{9}$$

The flow of the molten metal q ($m^3$/s) that flows from the ladle 2 at height h (m) above the outflow position is obtained from Bernoulli's theorem. It is given by the following expression (10):

$$q(t)=c\int_0^{h(t)}(L_f(h_b)\sqrt{2gh_b})dh_b,\ (0<c<1) \tag{10}$$

wherein $h_b$ (m) is, as shown in FIG. 4, the depth of the molten metal from its surface in the ladle 2, $L_f$(m) is the width of the outflow position at depth $h_b$ (m) of the molten metal, c is a coefficient of the flow of the molten metal that flows out, and g is the gravitational acceleration.

Further, the following expressions (11) and (12), which show the basic model of the expression for the flow of the molten metal, are obtained from the expressions (4), (9) and (10):

$$\frac{dV_r(t)}{dt}=-c\int_0^{\frac{V_r(t)}{A(\theta(t))}}\left(L_f(h_b)\sqrt{2gh_b}\right)dh_b-\frac{\partial V_s(\theta(t))}{\partial\theta}\omega(t) \tag{11}$$

$$q(t)=c\int_0^{\frac{V_r(t)}{A(\theta(t))}}\left(L_f(h_b)\sqrt{2gh_b}\right)dh_b,\ (0<c<1) \tag{12}$$

Also, the width of the rectangular-shaped outflow position of the ladle 2, $L_f$(m), is constant relative to $h_b$ (m), which is the depth from the surface of the molten metal in the ladle 2. Then the flow of the molten metal, q ($m^3/s$), that flows from the ladle 2 is obtained from the expression (10) and given by the following expression (13):

$$q(t) = \frac{2}{3} c L_f \sqrt{2g}\, h(t)^{3/2},\ (0 < c < 1) \tag{13}$$

This leads to the following: substitute the expression (13) for the values of each of the expressions (11) and (12), which show the basic model expressions for the flow of the molten metal, and then the following model expressions for the flow of the molten metal (14) and (15) are obtained:

$$\frac{dV_r(t)}{dt} = -\frac{2cL_f\sqrt{2g}}{3A(\theta(t))^{3/2}} V_r(t)^{3/2} - \frac{\partial V_s(\theta(t))}{\partial \theta}\omega(t) \tag{14}$$

$$q(t) = \frac{2cL_f\sqrt{2g}}{3A(\theta(t))^{3/2}} V_r(t)^{3/2},\ (0 < c < 1) \tag{15}$$

FIG. 5 shows a block diagram for controlling the position where the molten metal drops.

$q_{ref}$ ($m^3/s$) is a curve showing a target flow of the molten metal, u(V) is an input voltage for the motor, and $P_m$ and $P_f$ denote the dynamic characteristics of the motor and of the pouring process of the molten metal respectively.

$P_f^{-1}$ and $P_m^{-1}$ denote the inverse model for the model expression of the flow of the molten metal and the inverse model for the motor, respectively. A feed-forward control system for the flow of the molten metal is applied, using the inverse model of the pouring process, so that the flow of the molten metal that is actually poured follows the target flow pattern of the molten metal $q_{ref}$.

The feed-forward control is a method wherein the output is controlled so that it becomes a target value, by adjusting to the predetermined values those values that will be added to the objects to be controlled. By this method a favorable control can be achieved if the relationships of the input to the output in the objects to be controlled or the effects of a disturbance are obvious.

FIG. 6 is a linear block diagram for the control system that derives the input voltage u(V) that is supplied to the servomotors 3, 3, so as to realize the desired target flow pattern of the molten metal $q_{ref}$ ($m^3/s$). Here, the inverse model $P_m^{-1}$ of the servomotors 3,3 is given by the following expression (16):

$$u(t) = \frac{T_m}{K_m}\frac{d\omega_{ref}(t)}{dt} + \frac{1}{K_m}\omega_{ref}(t) \tag{16}$$

An inverse model of the basic model expression for the flow of the molten metal as shown in expressions (11) and (12) will be obtained. The flow of the molten metal, q ($m^3/s$), which is the volume of the molten metal that flows at a height h (m) above the outflow position, can be obtained from the expression (10), which is Bernouilli's theorem. The maximum height, $h_{max}$ (m), is equally divided by n. Each divided height is denoted by Δh (m), wherein $h_{max}$ (m) is the height above the outflow position when from the shape of the ladle 2 the volume above the outflow position is considered as being the largest. Each height of the molten metal $h_i$ is shown as $h_i = i\Delta h$ (i=0, . . . n). Thus the flow of the molten metal that flows, $q=(q_0, q_1 \ldots q_n)^T$, for the height, $h=(h_0, h_1 \ldots h_n)^T$, is shown by the following expression (17):

$$q = f(h) \tag{17}$$

wherein function f(h) is Bernoulli's theorem as shown by the expression (10). Thus the inverse function of the expression (17) is given by the following expression (18):

$$h = f^{-1}(q) \tag{18}$$

This expression (18) can be obtained by inverting the relationship of the input and output factors in the expression (17). (h) in expression (18) is obtained from the "Lookup Table." Now, if $q_i \rightarrow q_{i+1}$, and $h_i \rightarrow h_{i+1}$ then the relationship can be expressed by a linear interpolation. If the width that is obtained after the height, $h_{max}$ (m), is divided is narrower, the more precisely can be expressed the relationship of the flow of the molten metal, q ($m^3/s$), to the height h (m) above the outflow position. Thus it is desirable to make the width of the division as narrow as practically possible.

The height of molten metal above the outflow position, $h_{ref}$ (m), which is to achieve the desired flow pattern of the molten metal, $q_{ref}$ ($m^3/s$), is obtained from the expression (18) and is shown by the following expression (19):

$$h_{ref}(t) = f^{-1}(q_{ref}(t)) \tag{19}$$

Also, given that the height of the molten metal above the outflow position is $h_{ref}$ (m), the volume of the molten metal above the outflow position, $V_{ref}$ (m), is shown by the expression (20), which is obtained from the expression (9).

$$V_{ref}(t) = A((\theta(t))h_{ref}(t) \tag{20}$$

Next, if the volume of the molten metal above the outflow position, $V_{ref}$ (m), as shown by the expression (20) and the desired flow pattern of the molten metal, $q_{ref}$ ($m^3/s$), are substituted for the values in the basic model expression (11) for the flow of the molten metal, then the following expression (21) is obtained. It shows the angular velocity of the tilting of the ladle 2, $\omega_{ref}$ (degree/s). This angular velocity is to achieve the desired flow pattern of the molten metal.

$$\omega_{ref}(t) = -\frac{\frac{dV_{rref}(t)}{dt} + q_{ref}(t)}{\frac{\partial V_s(\theta(t))}{\partial \theta(t)}} \tag{21}$$

By solving in turn the expressions (17) to (21) and substituting the angular velocity of the tilting of the ladle 2, $w_{ref}$ (degree/s), which was obtained, for the values in the expression (16), so as to produce the desired flow pattern of the molten metal, $q_{ref}$ ($m^3/s$), the input voltage for control, u (V), which is to be supplied to the servomotors 3, 3, can be obtained.

Also, the volume of the molten metal above the outflow position, $V_{ref}$ (m), which is to achieve the desired flow pattern of the molten metal, $q_{ref}$ ($m^3/s$), is expressed by the following expression (22) by using the expression (15):

$$V_{rref}(t) = \frac{3A(\theta(t))}{(2cL_f\sqrt{2g})^{2/3}} q_{ref}(t)^{2/3} \tag{22}$$

Substitute both the volume of the molten metal above the outflow position, $V_{ref}$ (m), which was obtained from expression (22), and the desired flow pattern of the molten metal, $q_{ref}$ ($m^3/s$), for the values in the expression (21). Then the angular velocity of the tilting of the ladle 2, $w_{ref}$(degree/s), which is to achieve the desired flow pattern of the molten metal, is obtained. Next, substitute the angular velocity of the tilting of the ladle 2, $w_{ref}$(degree/s), that was obtained, for the value of the inverse model of the expression (16) for the servomotors 3, 3. Then the input voltage for control, u (V), that is to be supplied to the servomotors 3,3 can be obtained.

In FIG. 5, $P_0$ denotes the characteristics of the transmission of the molten metal, starting from the flow of the molten metal that flows from the ladle to the position where the molten metal drops in the cup of the sprue of the mold. Also, FIG. 7 shows a process where the molten metal flows from the ladle into the mold.

In FIG. 7, $S_w$(m) denotes the height from the outflow position 4 of the ladle to the sprue 5 of the mold. $S_v$(m) denotes the length in the horizontal direction from the tip of the outflow position 4 of the ladle to the position where the molten metal drops on the surface of the sprue 5. $A_p$ ($m^2$) denotes a cross-sectional area of the molten metal at the tip of the outflow position of the ladle. Ac ($m^2$) denotes a cross-sectional area of the molten metal that drops on the surface of the sprue of the mold 5. The average speed of the molten metal at the tip of the outflow position, $v_f$(m/s), is given by the expression (23):

$$v_f(h(t)) = \frac{q(h(t))}{A_p(h(t))} \tag{23}$$

$v_f$(h(t)) (m/s) depends on the height of the molten metal above the outflow position, h (t) (m). In the process where the molten metal flows from the ladle, given that the horizontal cross-sectional area of the molten metal is constant, the relationship between the cross-sectional areas $A_p$($m^2$) and $A_c$($m^2$) is given by the expression (24).

$$A_c(t+T_f)=A_p(t) \tag{24}$$

where $T_f$(s) is the period of time after the molten metal falls from the tip of the outflow position until it reaches the upper surface of the sprue. The relationship between $S_w$(m) and $S_v$(m) are given by the following expressions (25) and (26):

$$s_v(t) = v_f(t_0)(t - t_0) \tag{25}$$

$$s_w(t) = \frac{1}{2}g(t - t_0)^2 \tag{26}$$

$t_0$(s) show the time when the molten metal passes the tip of the outflow position of the ladle.

If a servomotor that tilts the ladle is provided at the tip of the outflow position, the position of the tip of the outflow position does not change. But if a servomotor that tilts the ladle is provided at the center of gravity of the ladle, as shown in FIG. 1, the locus of the tip of the outflow position shows a circular-shaped arch with the rotating axis of the servomotor as its rotating center. Thus a control system is to be constructed in such a way that the tip of the outflow position does not move, by causing the operation of the servomotor that moves the ladle up and down, and the servomotor that moves the ladle backward and forward, to be coordinated with that of the servomotor that tilts the ladle. In this way, the height of the tip of the outflow position is kept constant. From the expression (26), it is seen that the period of time after the molten metal falls from the tip of the outflow position until it reaches the upper surface of the sprue of the mold is given by the expression (27).

$$T_f = t_1 - t_0 = \sqrt{\frac{2S_w}{g}}$$

where $S_w$ [m] denotes the height between the tip of the outflow position and the upper surface of the sprue of the mold when a system is applied, wherein the servomotor that moves the ladle up and down and the servomotor that moves the ladle backward and forward are controlled to work in coordination with the servomotor that tilts the ladle, and the position of the tip of the outflow position of the ladle is kept constant during the tilting of the ladle, and where $t_1$ [s] denotes the time when the molten metal that flows from the ladle reaches the sprue. From the expressions (25) and (27), it is seen that the position in the horizontal direction where the molten metal drops on the upper surface of the sprue of the mold is given by the following expression (28):

$$S_v = v_f(t_0)\sqrt{\frac{2S_w}{g}}$$

The estimated flow, $v_f$(t) [m/s], (with a bar above the "v") is obtained, in the term $E_f$ of the estimated flow of the molten metal that is poured, from the expression (29):

$$\bar{v}_f(t) = \frac{q_{ref}(t)}{A_p(\bar{h}(t))} \tag{29}$$

The cross section, $A_p$ [$m^2$], can be obtained from the shape of the tip of the outflow position and the height of the molten metal at the tip of the outflow position, h(t) [m]. Thus the estimated height of the molten metal h(t) [m] (with a bar above the "h") for the target flow of the molten metal is obtained by expressing it as an inverse problem as given by the expression (31), just as from Bernoulli's theorem, given by the expression (30), the height of the molten metal is obtained from the flow of the molten metal.

$$q(t)=c\int_0^{h(t)}(L_f(h_b)\sqrt{2gh_b})dh_b \tag{30}$$

$$\bar{h}(t)=f^{-1}(q_{ref}(t)) \tag{31}$$

In the expression (30), $L_f$ denotes the width of the outflow position at the depth of the molten metal $h_b$ [m] above the tip of the outflow position that is shown in FIG. 4.

The expression (31) can be obtained by making an input-output table using the expression (30) of the direct problem and then inverting the relationship of the input and output factors. Also, the cross-sectional area can be obtained from the shape of the outflow position by using the expression (32):

$$A_p(\bar{h}(t))=\int_0^{h(t)}L_f(h_b)dh_b \tag{32}$$

Thus by using the expressions (29), (31), and (32), the flow rate can be estimated. The estimated position where the molten metal drops, $S_v$(t) [m], (with a bar above the "S"), in the term $E_0$ of the estimated position where the molten metal drops, can be obtained by substituting the value in the expression (28) for the value of the estimated flow obtained from the expression (29).

The term for controlling the position where the molten metal drops, Gy, denotes a feedback control system of a position which system controls the position of the ladle in its backward and forward movement and that causes the difference between the estimated position where the molten metal drops and its targeted position to converge to zero. By data on the estimated position where the molten metal drops being fed into the system that controls the position where the molten metal drops, the molten metal can be accurately poured into the target position of the sprue of the mold.

EXAMPLES

FIG. 8 shows the locus of the positions where the molten metal drops as obtained from the simulated tests, which locus indicates the usefulness of the system for controlling the position where the molten metal drops. FIG. 8 is a projected top view of the pouring system. Fig. (a) shows the results when the position where the molten metal drops is controlled and Fig. (b) shows the results when the position where the molten metal drops is not controlled. The thin line shows the cup of the sprue, the bold line shows the area where in the experiments the molten metal spreads farthest from the center of the cup of the sprue (the diameter of the molten metal that spreads), the dotted line shows where the center of the molten metal that drops and the center of the cup of the sprue are the farthest possible distance apart. The results show that when the system that controls the position where the molten metal drops is used, the molten metal drops into the cup of the sprue even if it is poured at a higher flow rate.

The tilting-type automatic pouring method of the present invention can be used in an apparatus when a conventional tilting-type automatic pouring apparatus is also provided with a transfer device that includes a servomotor for the backward and forward movement of the ladle, and an automatic pouring device and computer-controlled system for the transfer device. So, the apparatus of the method of the present invention can be suitably utilized in industries.

The basic Japanese Patent Application, No. 2007-120366, filed Apr. 28, 2007, is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various possible changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not limit the scope of the invention unless otherwise noted.

Figure 1:
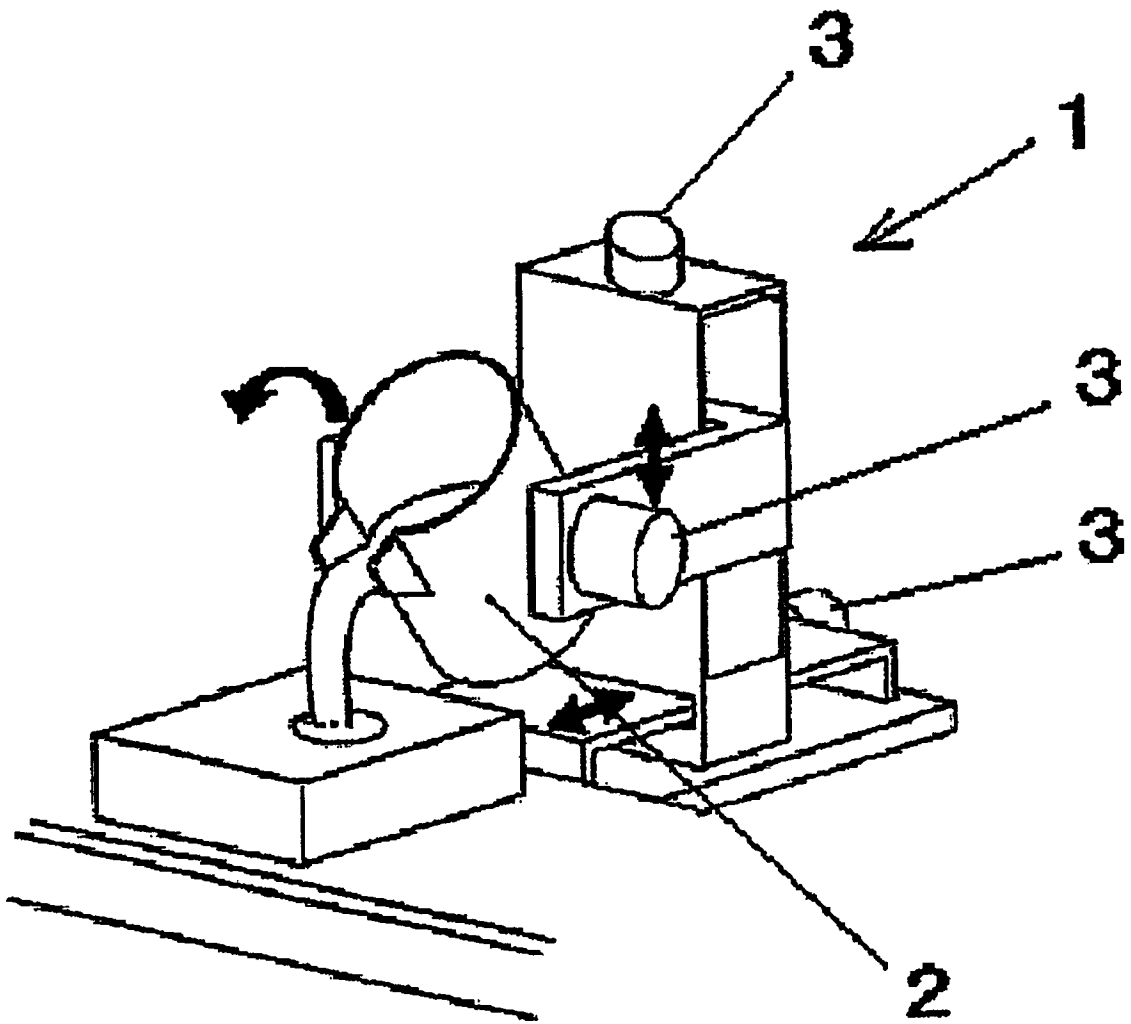
FIG. 1 shows a schematic view of the tilting-type automatic pouring apparatus to which the method of the present invention is applied.
Figure 2:
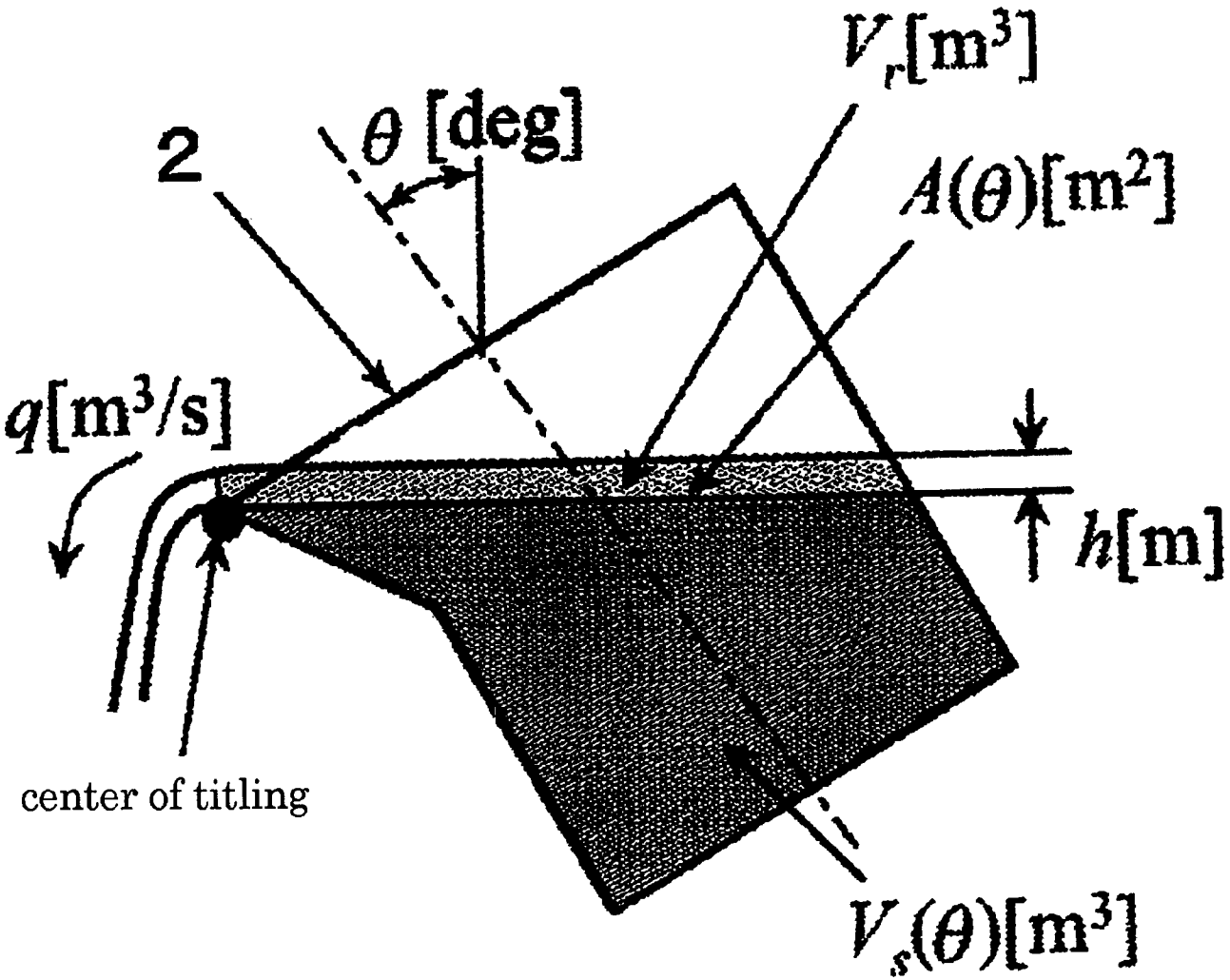
FIG. 2 is a vertical cross-sectional view of the ladle of the tilting-type automatic pouring apparatus of FIG. 1.
Figure 3:
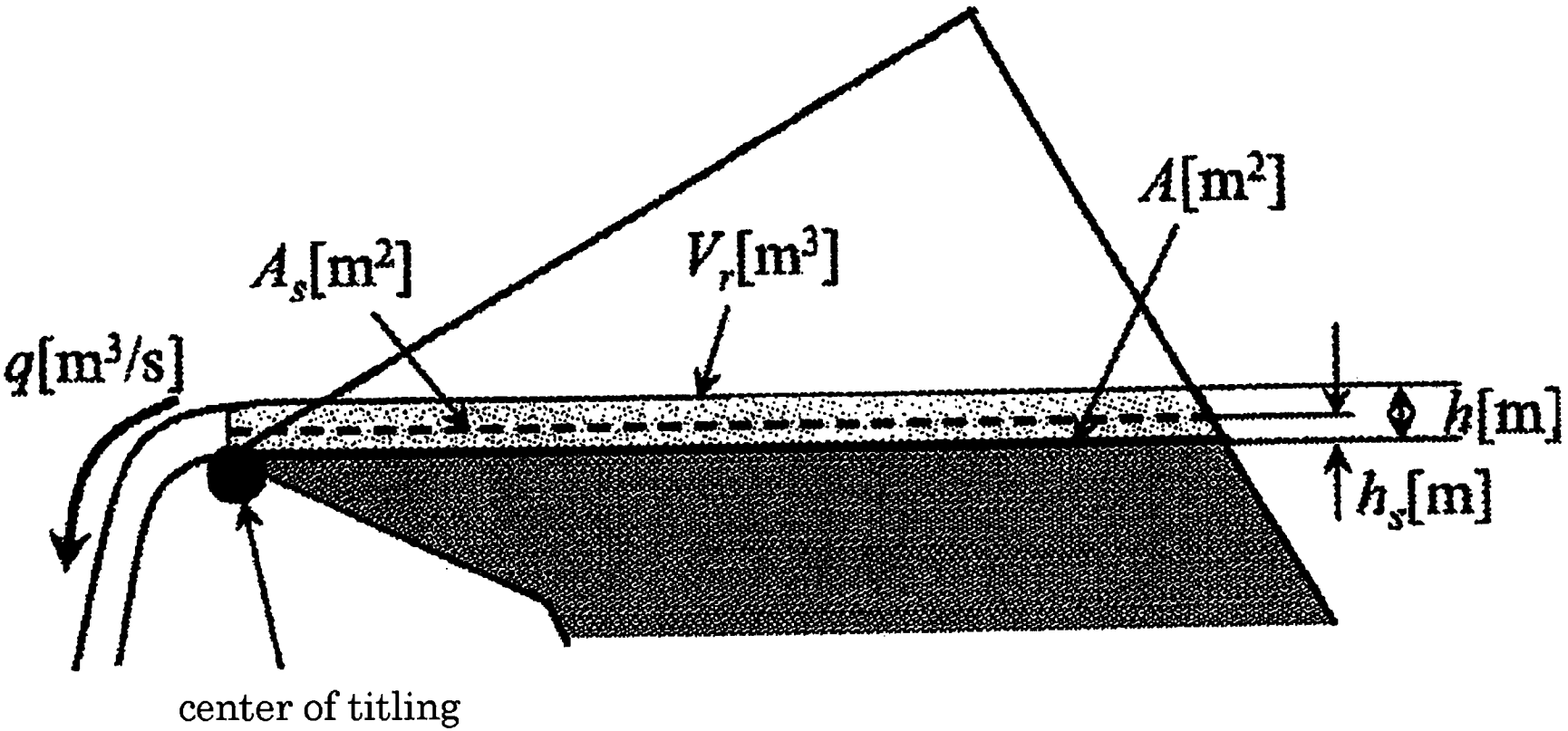
FIG. 3 is an enlarged view of the main part of FIG. 2.
Figure 4:
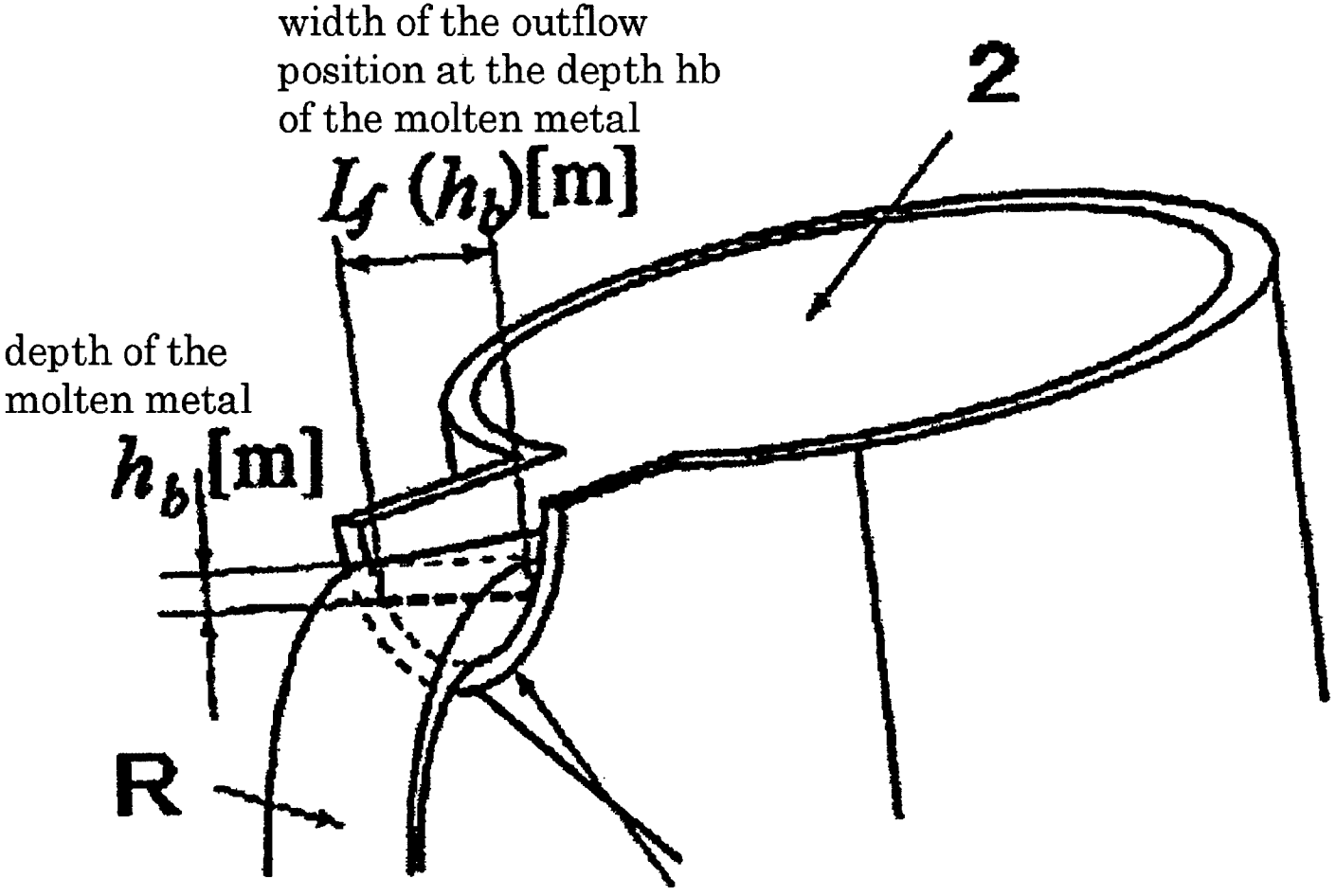
FIG. 4 shows the tip of the outflow position.
Figure 5:
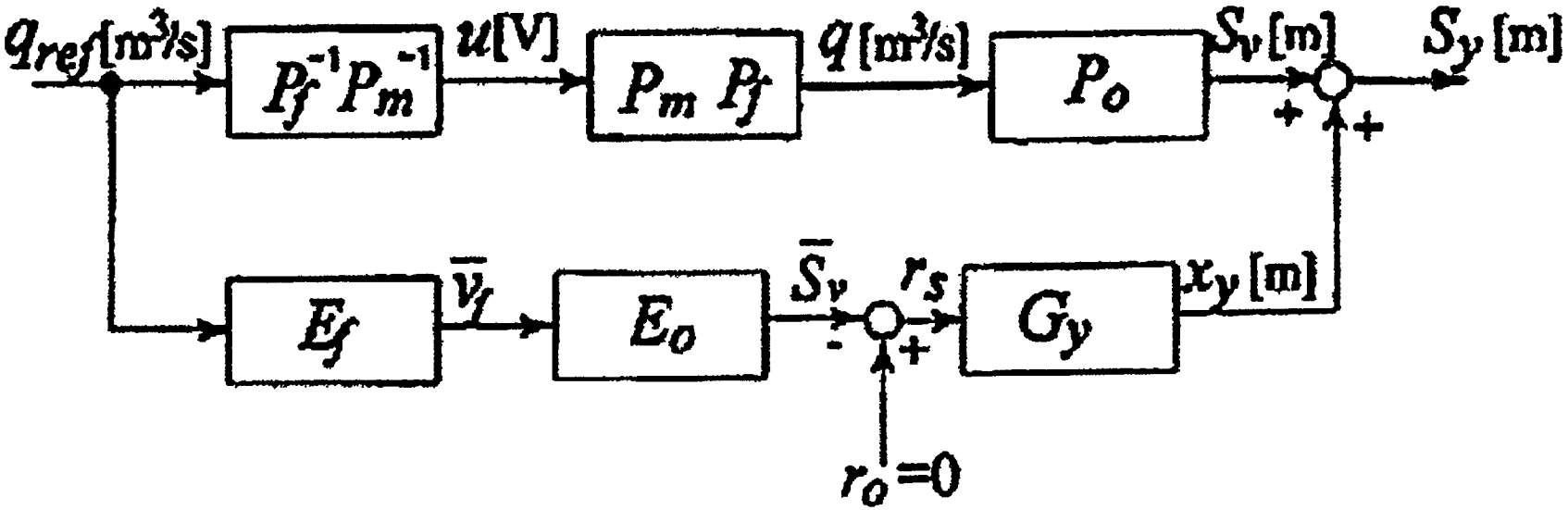
FIG. 5 is a schematic diagram that shows the system to control the position where the molten metal drops.
Figure 6:
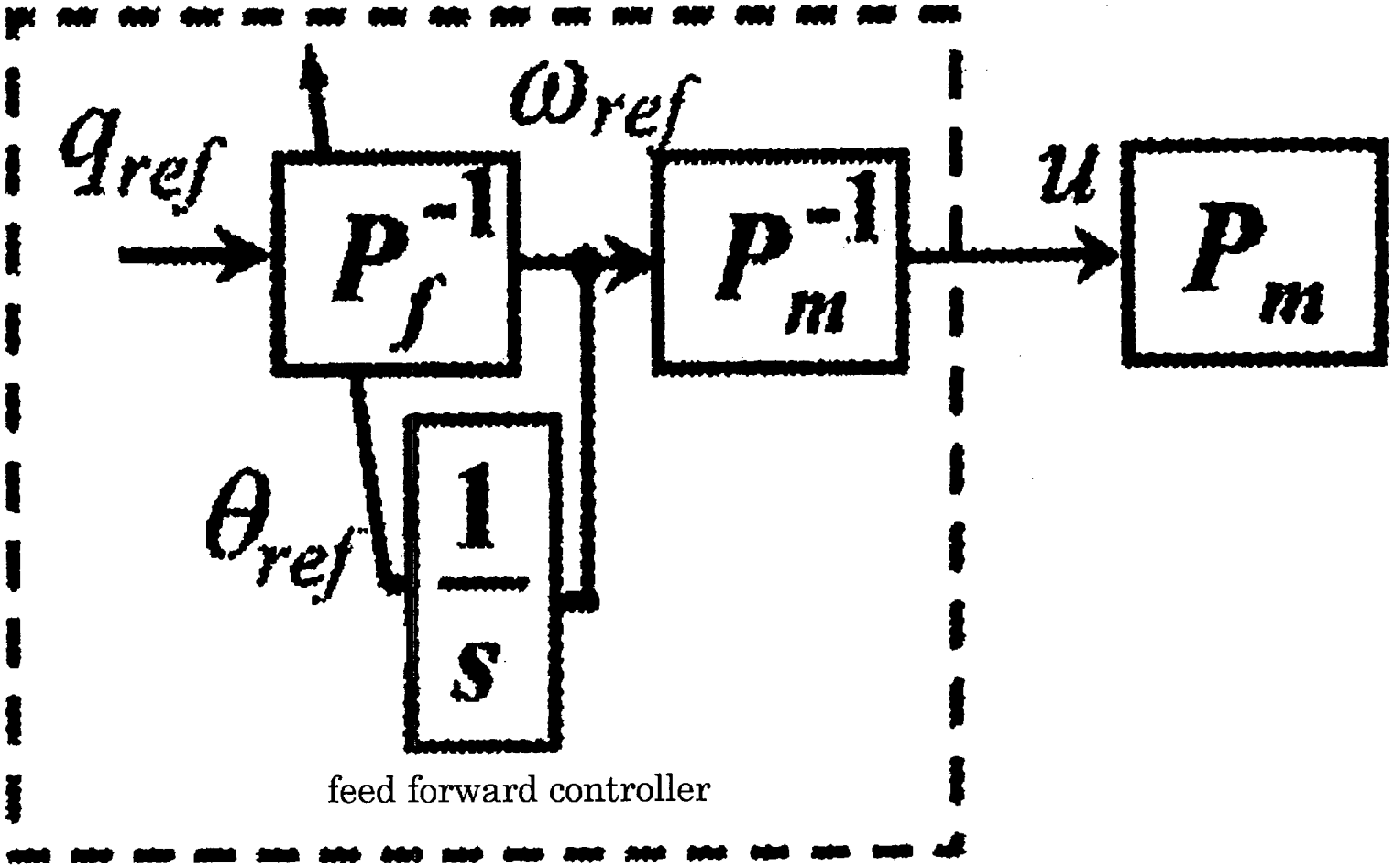
FIG. 6 is a block diagram that shows the feed-forward control system for the flow of the molten metal.
Figure 7:
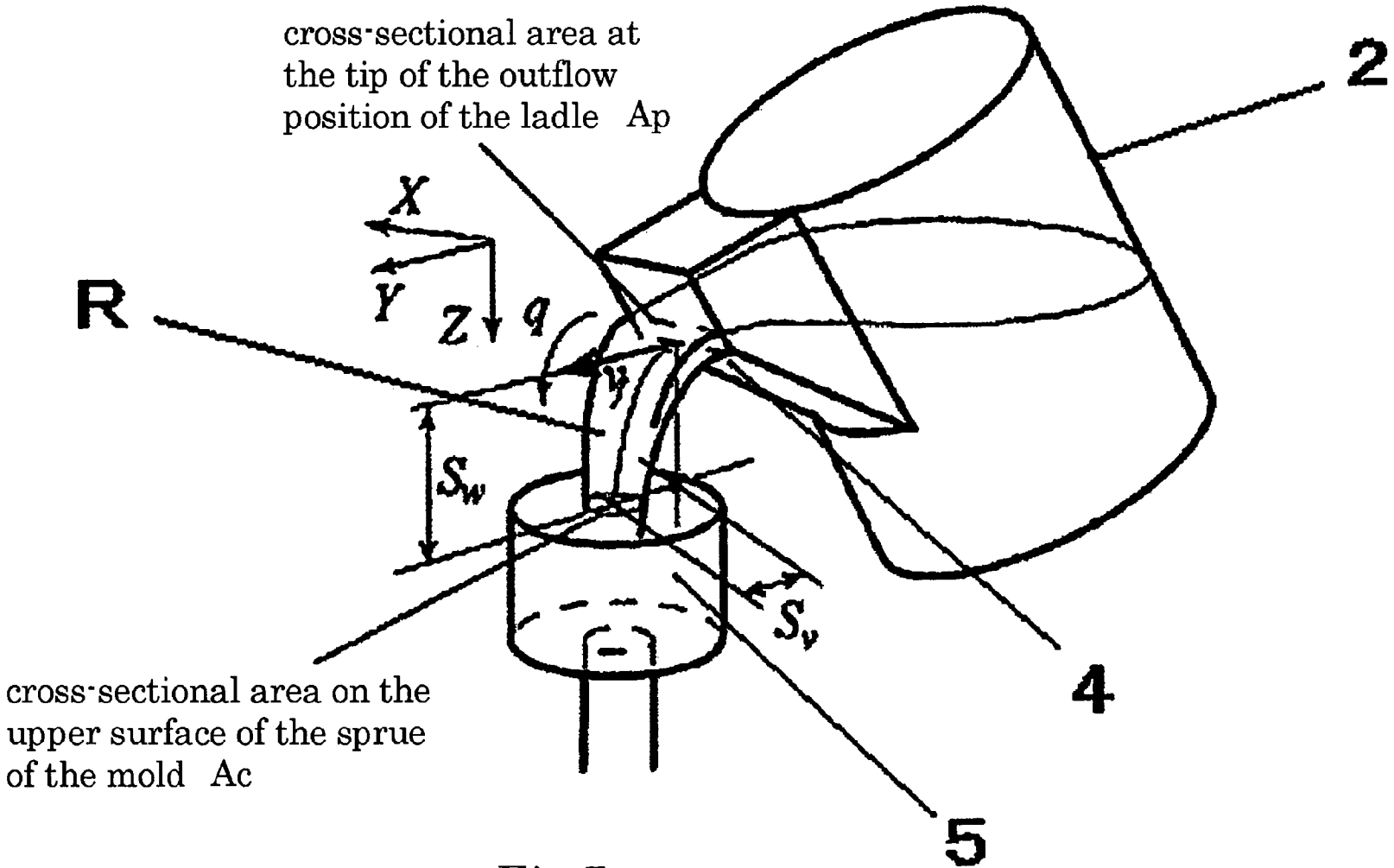
FIG. 7 shows the pouring process of the present invention.
Figure 8:
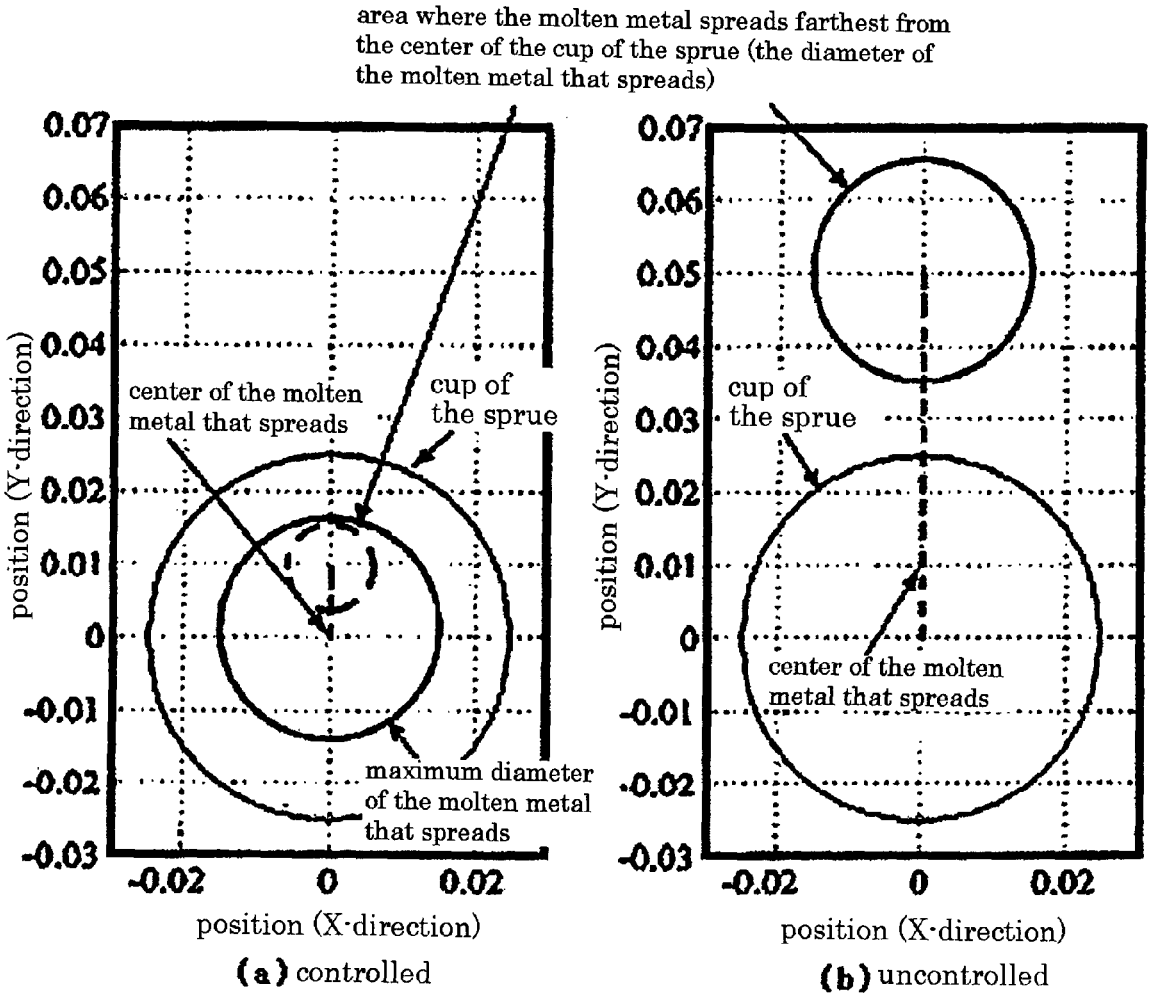
FIG. 8 shows the locus of the positions where the molten metal drops as obtained from the simulated experiments.

1. tilting-type automatic pouring apparatus
2. ladle
3. servomotor
4. outflow position of the ladle
5. sprue of the mold
6. molten metal

The invention claimed is:

1. A tilting-type automatic pouring method for controlling a ladle to pour molten metal into a sprue of a mold by controlling voltages supplied to a first servomotor tilting the ladle, a second servomotor moving the ladle backward and forward, and a third servomotor lifting and lowering the ladle, the method comprising:

obtaining a mathematical model describing a locus of positions where the molten metal flowing from the ladle drops on an upper surface of the sprue, the mathematical model including:

a first term describing a first relationship between a target flow rate of the molten metal flowing from the ladle when the ladle is tilted and a speed of the molten metal flowing out of the ladle, and a second term describing a second relationship between the speed and a position where the molten metal drops on the upper surface of the sprue;

solving an inverse problem of the mathematical model;

estimating the position where the molten metal drops using a result of the solving of the inverse problem;

determining target voltages to be supplied to the first, second, and third servomotors, at least the target voltage to be supplied to the second servomotor being determined based on the estimated position; and controlling the first, second, and third servomotors based on the respective target voltages.

2. A computer-readable non-transitory storage medium storing a program for controlling a ladle to pour molten metal into a sprue of a mold by controlling voltages supplied to a first servomotor tilting the ladle, a second servomotor moving the ladle backward and forward, and a third servomotor lifting and lowering the ladle, whereby the molten metal is poured into a mold by the tilting of the ladle, the program, when executed, controlling a computer to:

produce a mathematical model describing a locus of positions where the molten metal flowing from the ladle drops on an upper surface of the sprue, the mathematical model including:

a first term describing a first relationship between a target flow rate of the molten metal flowing from the ladle when the ladle is tilted and a speed of the molten metal flowing out of the ladle, and a second term describing a second relationship between the speed and a position where the molten metal drops on the upper surface of the sprue;

solve an inverse problem of the mathematical model;

estimate the position where the molten metal drops based on a result of the solving the inverse problem;

determine target voltages to be supplied to the first, second, and third servomotors, at least the target voltage to be supplied to the second servomotor being determined based on the estimated position; and control the first, second, and third servomotors based on the respective target voltages.

* * * * *